US008807453B2

(12) United States Patent
Hsieh

(10) Patent No.: US 8,807,453 B2
(45) Date of Patent: Aug. 19, 2014

(54) ROTARY SPRAY NOZZLE

(76) Inventor: I-Shuan Hsieh, Taoyuan (TW)

( * ) Notice: Subject to any disclaimer, the term of this patent is extended or adjusted under 35 U.S.C. 154(b) by 231 days.

(21) Appl. No.: 13/615,581

(22) Filed: Sep. 13, 2012

(65) Prior Publication Data

US 2014/0070024 A1 Mar. 13, 2014

(51) Int. Cl.
*B05B 3/06* (2006.01)

(52) U.S. Cl.
USPC ..... 239/227; 239/226; 239/251

(58) Field of Classification Search
CPC ..... B05B 3/008; B05B 3/028; B05B 3/0409; B05B 3/06; B05B 7/0433; B05B 7/066; B05B 7/2435; B08B 3/026; B08B 3/028
USPC ..... 239/225.1, 226, 227, 229, 251, 259, 239/288–288.5, 310, 318, 525, 526
See application file for complete search history.

(56) References Cited

U.S. PATENT DOCUMENTS

2006/0065760 A1* 3/2006 Micheli ..... 239/237
2009/0057443 A1* 3/2009 Sendo ..... 239/405
2010/0320289 A1* 12/2010 Kuo ..... 239/290

* cited by examiner

*Primary Examiner* — Darren W Gorman

(57) ABSTRACT

A rotary spray nozzle includes a barrel, a coupling tube set including a coupling tube rotatably supported in axle bearings inside the barrel, a pressure tube connected to one end of the barrel and defining a gas intake passage that is kept in fluid communication with the coupling tube and reduces in direction toward the coupling tube for causing a Venturi effect to pressurize a flow of compressed gas and fluid passing therethrough, and a bent nozzle tube connected to one end of the coupling tube remote from the pressure tube for free rotation with the coupling tube relative to the barrel when the pressurized flow of compressed gas and fluid is passing out.

5 Claims, 7 Drawing Sheets

ROTARY SPRAY NOZZLE

BACKGROUND OF THE INVENTION

1. Field of the Invention

The present invention relates to spray nozzles and more particularly, to a rotary spray nozzle, which pressurizes an intake flow of compressed air and fluid to enhance rotation of a bent nozzle tube.

2. Description of the Related Art

A high-pressure spray gun for aerated pressure washing employs the Venturi effect to enhance the pressure of a flow of compressed gas and fluid passing through a spray nozzle, causing rotation of a bent nozzle tube. This nozzle tube rotating method uses an outer sleeve to rotate the bent nozzle tube. Thus, the spray nozzle has a large dimension and heavy weight, and requires much dynamic energy to rotate the outer sleeve and the bent nozzle tube. Further, the pressure produced subject to the Venturi effect according to this prior art design is limited. The pressure of the sprayed flow of fluid may be insufficient to achieve optimal aerated pressure washing.

SUMMARY OF THE INVENTION

The present invention has been accomplished under the circumstances in view. It is one object of the present invention to provide a rotary spray nozzle, which has compact size and light weight characteristics, and is practical for use in a spray gun to enhance the aerated pressure washing efficiency of the spray gun.

To achieve this and other objects of the present invention, a rotary spray nozzle comprises a barrel, a coupling tube set comprising a coupling tube rotatably supported in axle bearings inside the barrel and defining therein a flow passage, a pressure tube connected to one end of the barrel and defining therein a gas intake passage that is kept in communication with the flow passage of the coupling tube and reduces gradually in direction toward the flow passage of the coupling tube, and a bent nozzle tube connected to one end of the coupling tube remote from the pressure tube for free rotation with the coupling tube relative to the barrel and defining therein a spiral flow passage in communication with the flow passage of the coupling tube.

DETAILED DESCRIPTION OF THE PREFERRED EMBODIMENT

Figure 1:
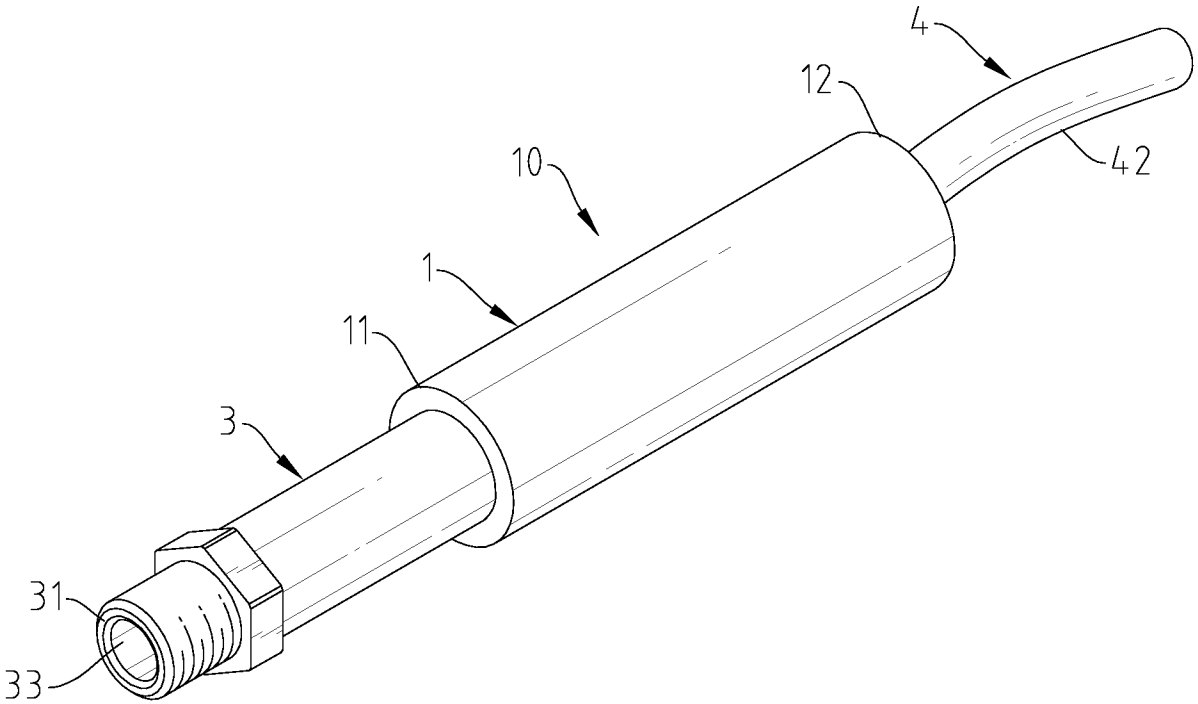
FIG. 1 is an elevational view of a rotary spray nozzle in accordance with the present invention.
Figure 2:
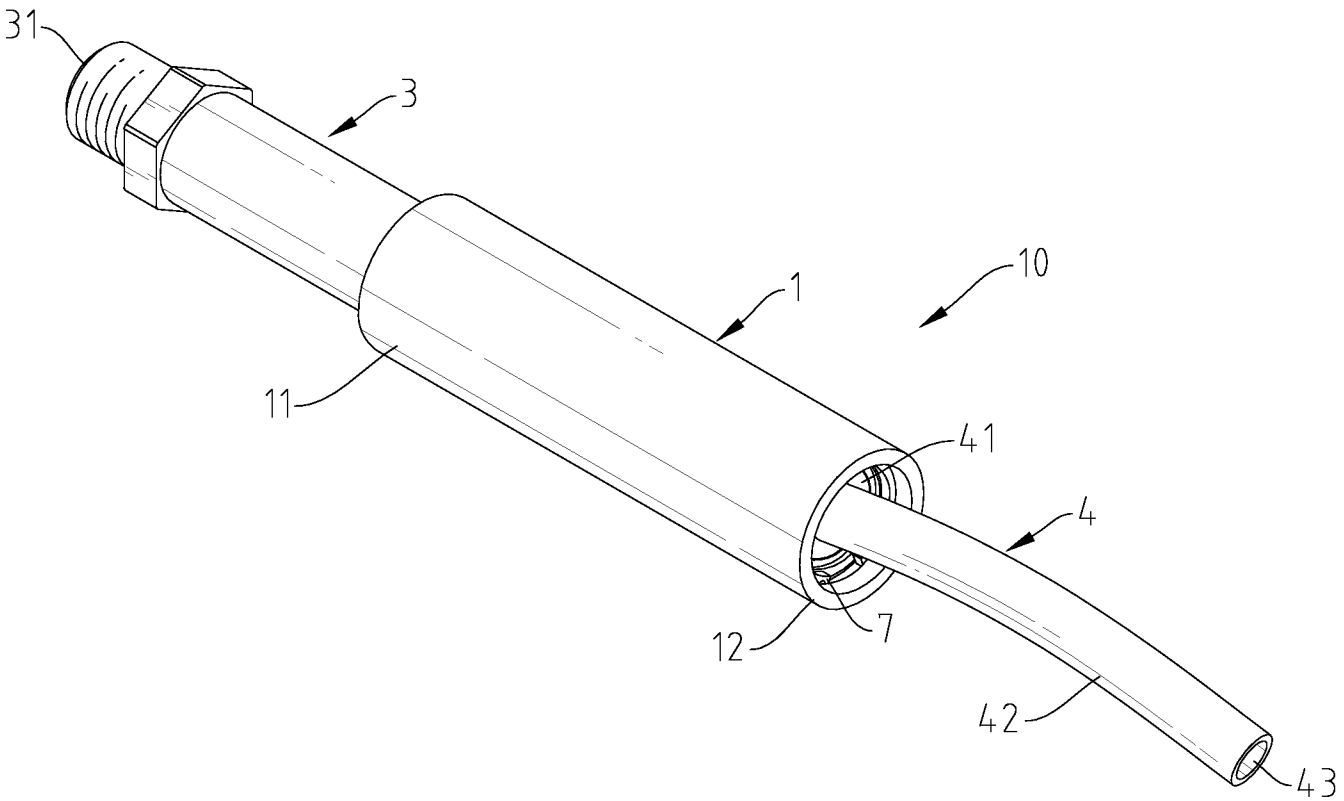
FIG. 2 is another elevational view of the rotary spray nozzle in accordance with the present invention when viewed from another angle.
Figure 3:
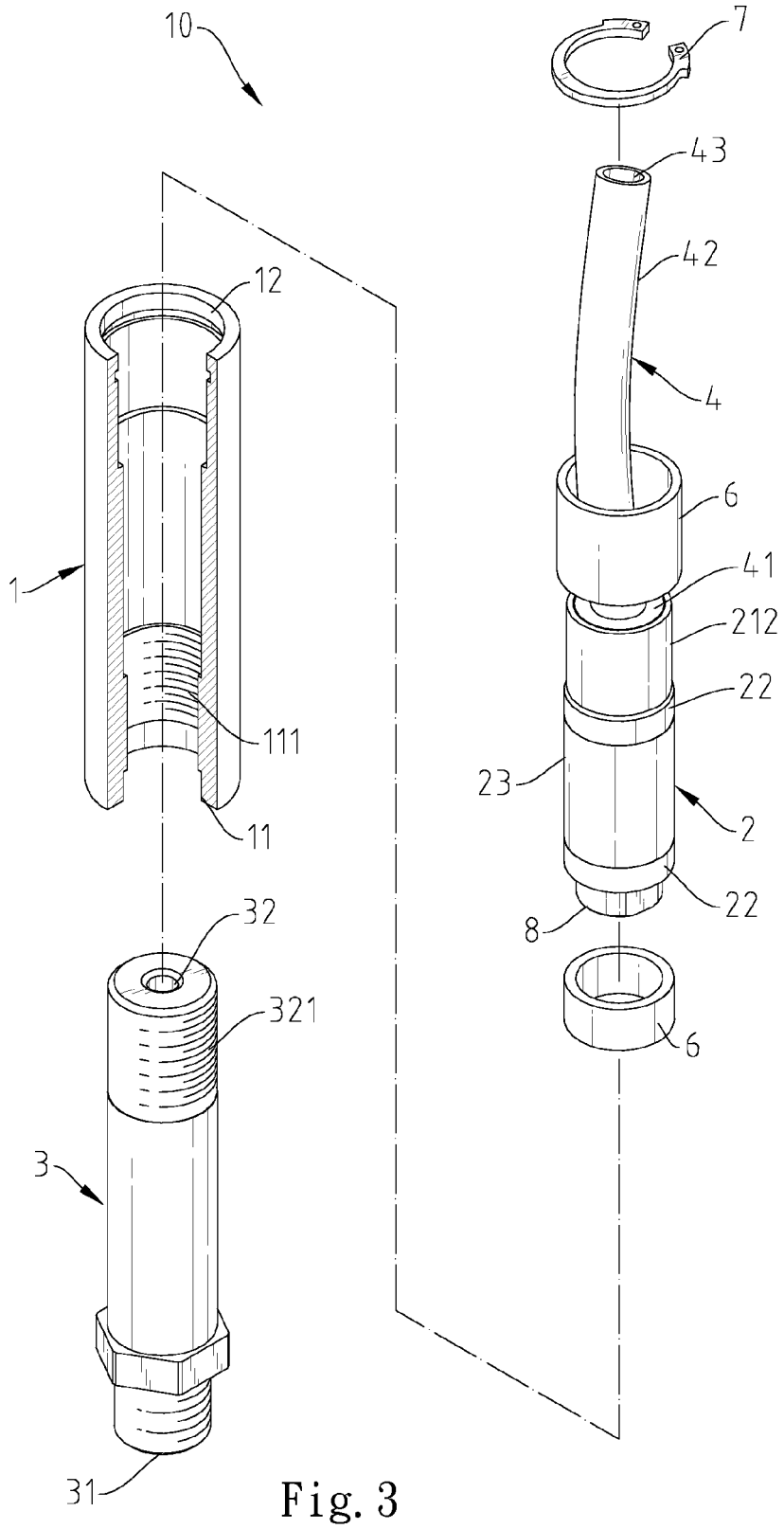
FIG. 3 is an exploded view, partially in sectional elevation, of the rotary spray nozzle in accordance with the present invention.
Figure 4:
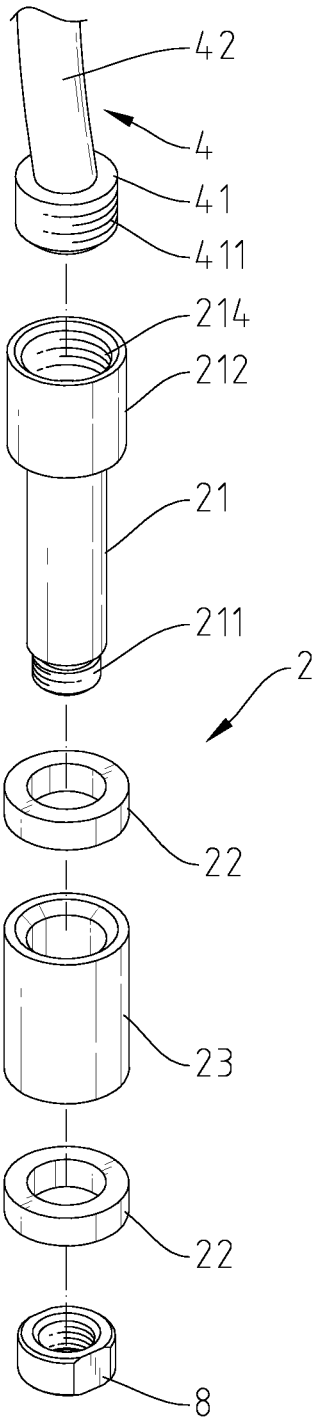
FIG. 4 is another exploded view of the rotary spray nozzle in accordance with the present invention.
Figure 5:
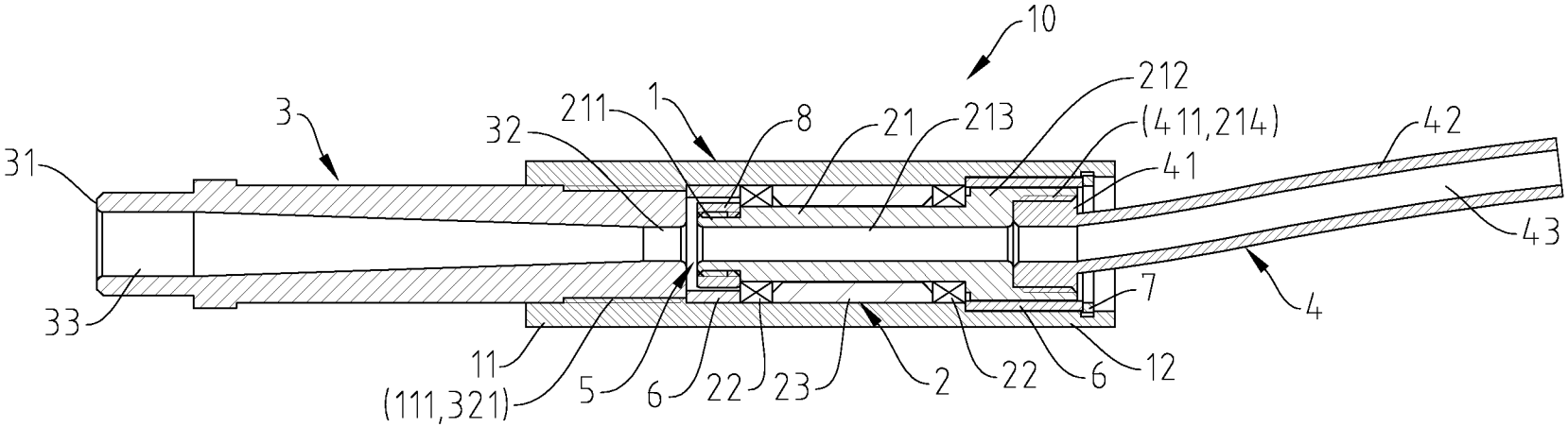
FIG. 5 is a longitudinal sectional view of the rotary spray nozzle in accordance with the present invention.

Referring to FIGS. 1-5, a rotary spray nozzle 10 in accordance with the present invention is shown comprising a barrel

1, a coupling tube set 2 set in the barrel 1, a pressure tube 3 connected to one end of the coupling tube set 2, and a bent nozzle tube 4 connected to the opposite end of the coupling tube set 2.

The barrel 1 comprises opposing first connection end 11 and second connection end 12, and an inner thread 111 on an inner perimeter of the first connection end 11.

The coupling tube set 2 comprises a coupling tube 21, which comprises opposing first mating end 211 and second mating end 212, an inner thread 214 on an inner perimeter of the second mating end 212 and a flow passage 213 in communication between the first mating end 211 and the second mating end 212, two axle bearings 22 mounted around the coupling tube 21, a locknut 8 threaded onto the first mating end 211 of the coupling tube 21, an intermediate bush 23 mounted around the coupling tube 21 and stopped between the two axle bearings 22, two end bushes 6 respectively sleeved onto the first mating end 211 and the second mating end 212 and mounted with the coupling tube 21, the two axle bearings 22 and the intermediate bush 23 in the barrel 1 to have the end bush 6 at the second mating end 212 be firmly secured to the inside of the second connection end 12 of the barrel 1, and a retainer 7, for example, a C-shaped retaining ring 7 fastened to the second mating end 212 and stopped between an inside part of the second connection end 12 of the barrel 1 and the associating end bush 6 to prohibit the coupling tube 21 of the coupling tube set 2 from escaping out of the barrel 1.

The pressure tube 3 comprises opposing gas inlet end 31 and gas outlet end 32, a gas intake passage 33 in communication between the gas inlet end 31 and the gas outlet end 32, and an outer thread 321 on the outer perimeter of the gas outlet end 32. The outer thread 321 is threaded into the inner thread 111 of the barrel 1. Further, the gas intake passage 33 is a tapered flow passage gradually reducing in direction from the gas inlet end 31 toward the gas outlet end 32. The gas outlet end 32 is connected to the first connection end 11 of the barrel 1. The gas intake passage 33 is kept in communication with the flow passage 213 of the coupling tube 21 of the coupling tube set 2. Further, a gas chamber 5 is defined between the gas outlet end 32 of the pressure tube 3 and the first mating end 211 of the coupling tube 21 of the coupling tube set 2.

The bent nozzle tube 4 comprises a connector 41 having an outer thread 411 threaded into the inner thread 214 of the coupling tube 21, a nozzle head 42 obliquely extended from the connector 41, a spiral flow passage 43 defined in the nozzle head 42 in communication with the flow passage 213 of the coupling tube 21 of the coupling tube set 2.

Figure 6:
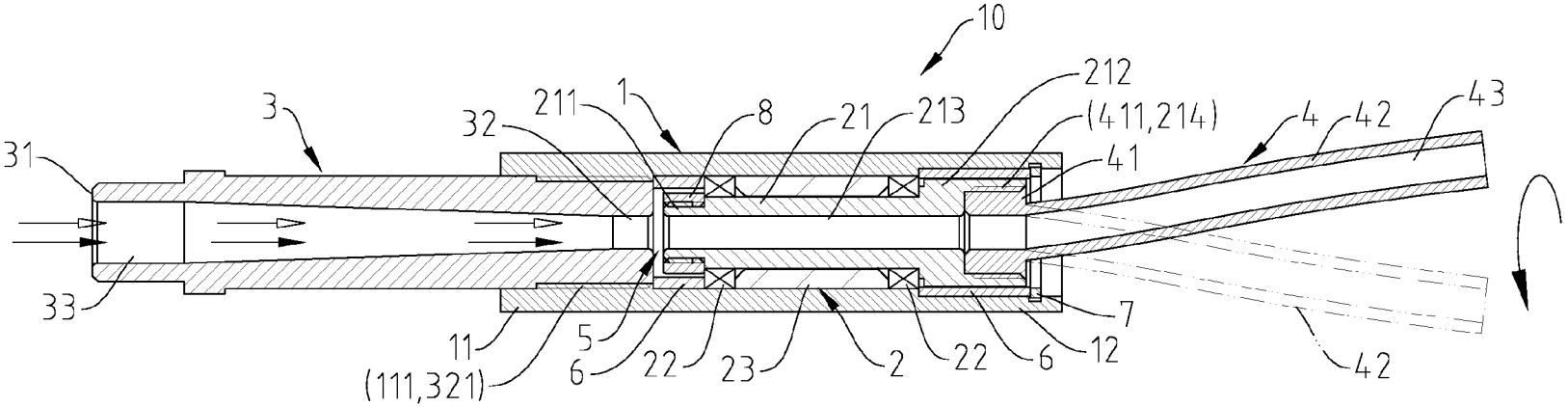
FIG. 6 is a schematic drawing of the present invention, illustrating an operation status of the rotary spray nozzle.
Figure 7:
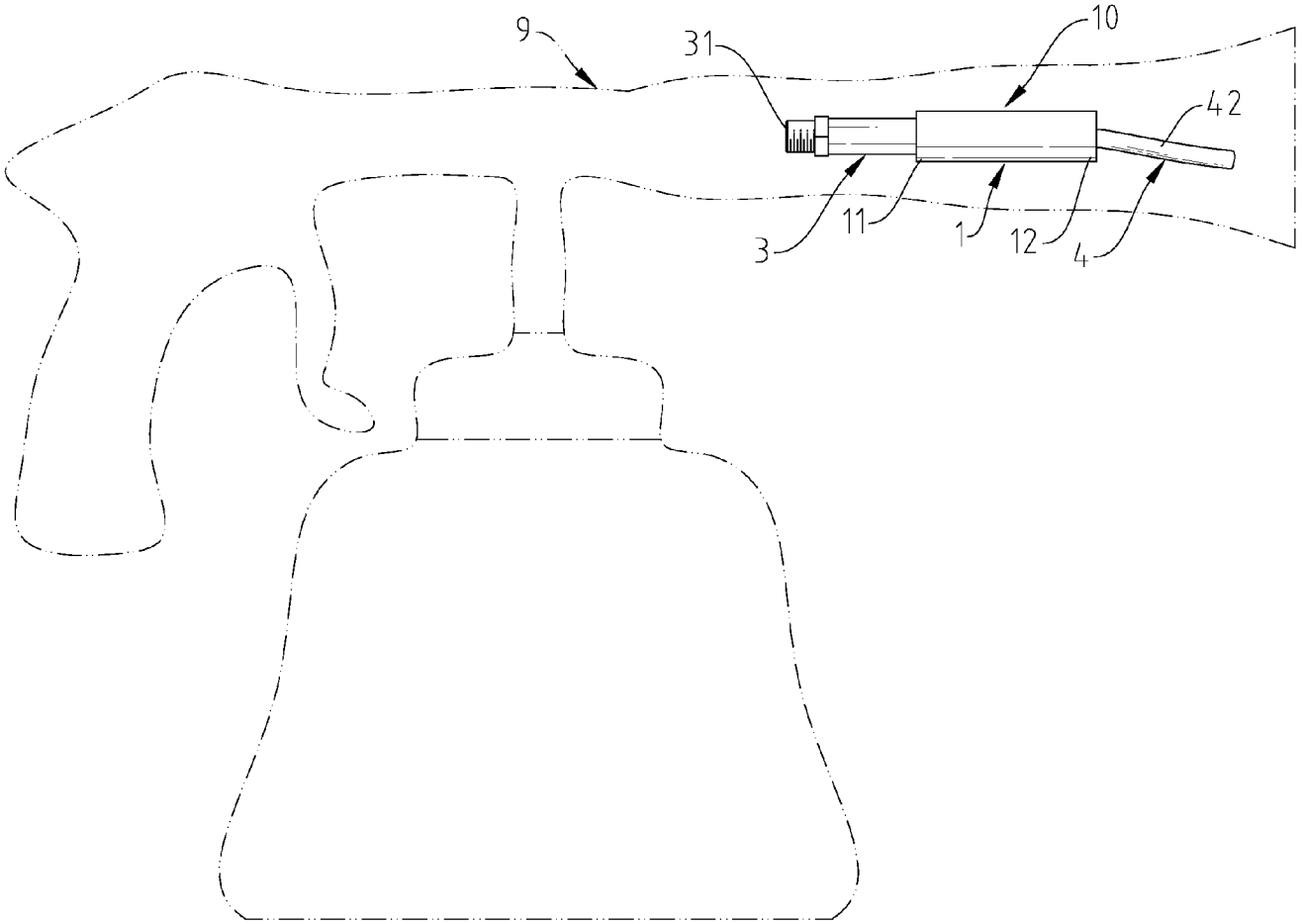
FIG. 7 is a schematic applied view of the present invention, illustrating the rotary spray nozzle used in a spray gun.

Referring to FIGS. 6 and 7, rotary spray nozzle 10 is mounted in a spray gun 9. During operation of the spray gun 9, a flow of compressed air and fluid goes through the gas inlet end 31 of the pressure tube 3 into the gas intake passage 33. Because the gas intake passage 33 is a tapered flow passage gradually reducing in direction from the gas inlet end 31 toward the gas outlet end 32, the pressure of the intake flow of compressed air and fluid will be increased gradually subject to the Venturi effect. Thereafter, the pressurized flow of compressed air and fluid goes through the flow passage 213 of the coupling tube 21 of the coupling tube set 2 toward the outside via the spiral flow passage 43 of the bent nozzle tube 4. Thus, when the pressurized flow of compressed air and fluid goes out of the spiral flow passage 43 of the bent nozzle tube 4, the nozzle head 42 will be forced to rotate rapidly, and the gas chamber 5 between the gas outlet end 32 of the pressure tube 3 and the first mating end 211 of the coupling tube 21 of the coupling tube set 2 prevents fiction between the coupling tube

21 and the pressure tube 3, facilitating rotation of the coupling tube 21 with the bent nozzle tube 4 relative to the barrel 1. Further, because the rotatable component parts of the rotary spray nozzle 10 are arranged inside the barrel 1, the rotary spray nozzle 10 has compact size and light weight characteristics, and the bent nozzle tube 4 can be easily rotated at a high speed, enhancing aerated pressure washing efficiency of the spray gun 9.

What the invention claimed is:

1. A rotary spray nozzle, comprising:

a barrel comprising an opposing first connection end and second connection end, and an inner thread on an inner perimeter of said first connection end;

a coupling tube set comprising a coupling tube, said coupling tube comprising an opposing first mating end and second mating end, an inner thread on an inner perimeter of said second mating end and a flow passage in communication between said first mating end and said second mating end, and at least one axle bearing mounted around said coupling tube and fastened to said barrel to support said coupling tube in said barrel and for allowing rotation of said coupling tube in said barrel;

a pressure tube comprising an opposing gas inlet end and gas outlet end, a gas intake passage in communication between said gas inlet end and said gas outlet end and an outer thread on an outer perimeter of said gas outlet end, the outer thread of said pressure tube being threaded into the inner thread of said barrel, said gas intake passage gradually reducing in direction from said gas inlet end toward said gas outlet end, said gas outlet end being connected to said first connection end of said barrel to keep said gas intake passage in communication with said flow passage of said coupling tube; and a bent nozzle tube comprising a connector, said connector comprising an outer thread threaded into the inner thread of said coupling tube, a nozzle head obliquely extended from said connector and a spiral flow passage defined in said nozzle head in communication with the flow passage of said coupling tube.

2. The rotary spray nozzle as claimed in claim 1, wherein said coupling tube set further comprises a gas chamber defined between the gas outlet end of said pressure tube and the first mating end of said coupling tube.

3. The rotary spray nozzle as claimed in claim 1, wherein said coupling tube set further comprises an intermediate bush sleeved onto said coupling tube between said first mating end and said second mating end and firmly secured to an inside part of said barrel.

4. The rotary spray nozzle as claimed in claim 1, wherein said coupling tube set further comprises an end bush sleeved onto the second mating end of said coupling tube and firmly secured to an inside part of the second connection end of said barrel.

5. The rotary spray nozzle as claimed in claim 1, wherein said coupling tube set further comprises a retainer fastened to the second mating end of said coupling tube to prohibit said coupling tube from escaping out of said barrel.

* * * * *